United States Patent [19]

Finkl et al.

[11] Patent Number: 4,541,862

[45] Date of Patent: Sep. 17, 1985

[54] LADLE STEELMAKING METHOD AND APPARATUS

[75] Inventors: Charles W. Finkl, Evanston; Albert L. Lehman, Glenview; Herbert S. Philbrick, Jr., Wilmette, all of Ill.

[73] Assignee: A. Finkl & Sons Co., Chicago, Ill.

[21] Appl. No.: 445,600

[22] Filed: Nov. 30, 1982

[51] Int. Cl.[4] ..... C21C 7/10; C21C 5/52

[52] U.S. Cl. ..... 75/12; 75/49

[58] Field of Search ..... 75/12, 49

[56] References Cited

U.S. PATENT DOCUMENTS 3,501,289 3/1970 Finkl ..... 75/49

3,501,290 3/1970 Finkl ..... 75/49

*Primary Examiner*—Peter D. Rosenberg

*Attorney, Agent, or Firm*—James G. Staples

[57] ABSTRACT

A ladle steelmaking process in which ramp modulation of vacuum boil, voltage shedding to avoid glow and multiple stirring sources are employed individually, or in any combination, with the basic vacuum are degassing parameters (vacuum, purging and AC area) to shorten cycle time, and apparatus therefore.

10 Claims, 3 Drawing Figures

LADLE STEELMAKING METHOD AND APPARATUS

This invention is directed to ladle steelmaking methods and apparatus, and specifically to improvements over the methods and apparatus disclosed in U.S. Pat. No. 3,501,289.

BACKGROUND OF THE INVENTION

Efforts were made in the mid-1960s to advance the art of ladle steelmaking as a result of increasing costs and other factors in the steel industry. One effort culminated in the system known as vacuum arc degassing which utilizes three essential features: subjection to proper vacuum levels; gas stirring; and alternating current (hereafter "AC") arc heating at a time when the steel is subjected to the simultaneous effect of the aforesaid vacuum and gas stirring. The treatment of the steel by subjection to vacuum and gas stirring culminated in the process described in U.S. Pat. No. 3,236,635, whose disclosure is incorporated herein by reference. This process, though used extensively commercially by the assignee of this invention, and, in subsequent years, by others, had a time limitation due to the permissible temperature drop of the steel. The further feature of AC arc heating as exemplified in U.S. Pat. No. 3,501,289 eliminated the temperature drop limitation and permitted end point degassing, as well as providing discretionary time which could be used to carry out other treatment, or, simply, as a holding expedient required by production limitations.

Since vacuum arc degassing, (sometimes hereafter referred to as VAD) has been developed and proven, this process and other ladle steelmaking techniques have established themselves as the quickest, simplest, and most economical way to make carbon and low alloy steels.

In fact, ladle steelmaking is now one of the most popular steelmaking techniques in the market today. Yet during this highly competitive period of steelmaking it is essential that the steelmaker further reduce his ladle steelmaking costs. This can be accomplished by reducing time, energy, and space required for ladle steelmaking.

Shortening process time is essential to increase throughput, thereby reducing capital costs per ton treated and enabling the VAD to keep up with UHP and pneumatic furnaces. In ladle steelmaking, time equates to temperature loss, as all the time steel is held in the ladle it is losing heat. This heat loss can be made up by superheating in the melting furnace or arc heating in the ladle. Either technique consumes costly electrical energy which can be appreciably reduced by shortening VAD process time using the following new and unique techniques.

Shortening process time also permits use of a single process station, whereby degassing and arc heating can be simultaneously carried out without the logistic complexities of multi-station, single purpose installations which consume both more time and space in the melt shop.

SUMMARY OF THE INVENTION

This invention is based on three novel improvements over the original three essentials of the VAD process, (i.e.: vacuum, arc heating, and some form of stirring). These enhancements can be applied singly, doubly, or simultaneously and are not interdependent as are the basic requirements of vacuum, arc heating, and stirring. The three new techniques are: (1) ramp modulating vacuum level to suit steel boil or process time; (2) proportionally changing online electrode voltage to vacuum levels to avoid incipient glow; and (3) providing a means of insuring sufficient metal circulation as heat size increases.

DESCRIPTION OF FIGURES

Certain features of the invention are illustrated more or less diagrammatically in the accompanying Figures wherein.

DESCRIPTION OF SPECIFIC EMBODIMENT

Figure 1:
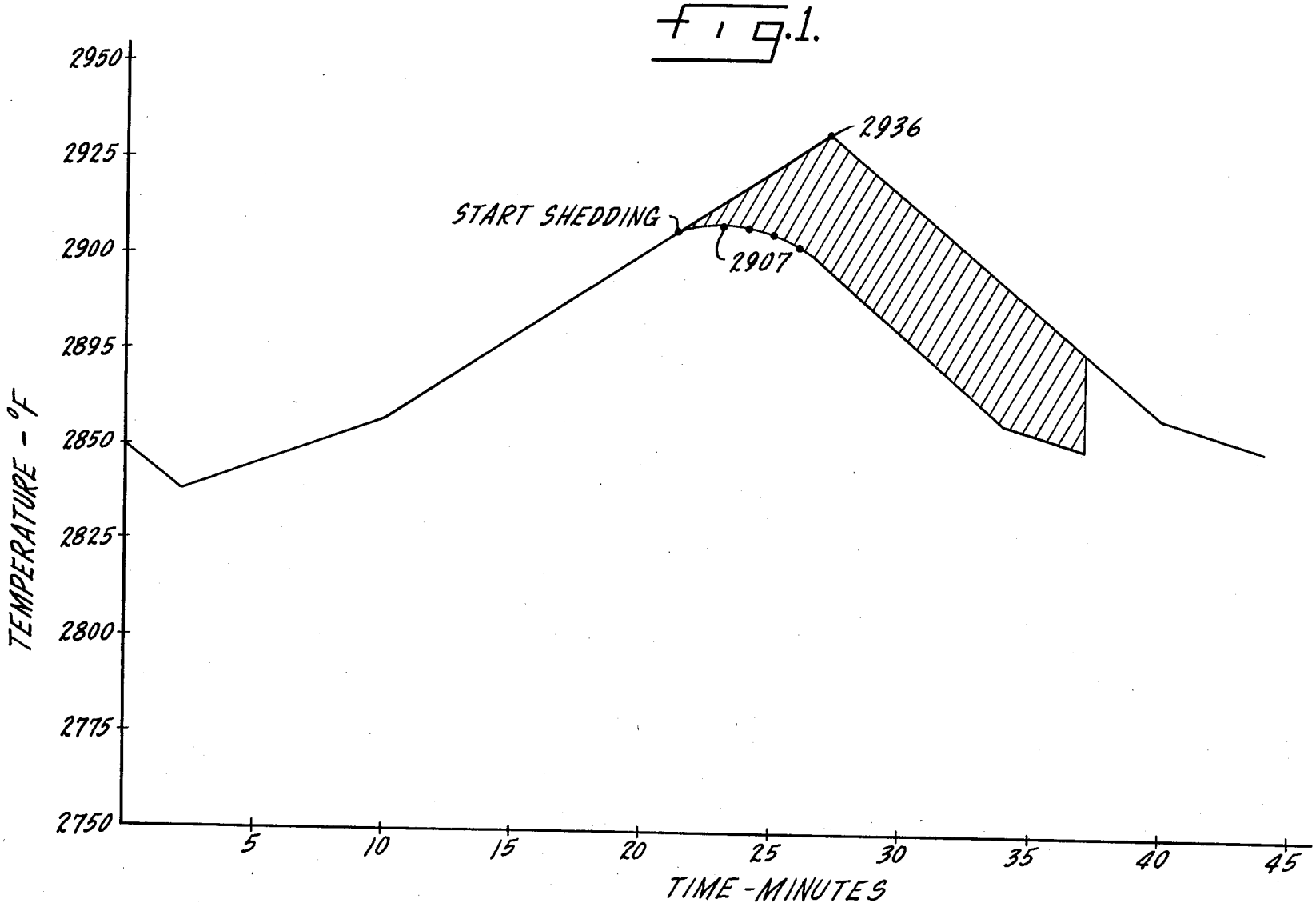
FIG. 1 is a graph illustrating the time saving achieved by application of the ramp modulating vacuum level feature.

The following is a description of the three techniques individually to avoid confusion.

I—Ramp Modulation of Vacuum Boil

The steam jet ejectors used in the basic VAD process typically have a compression ratio of close to $6\frac{1}{4}$:1. In order to quickly remove hydrogen, a vacuum level of about 0.5 millimeters mercury absolute is required, even though Sievart's law states that the solubility level of 1 ppm of hydrogen or less is considerably above that level. The difference between Sievart's and actual vacuum levels is the driving force necessary to allow the hydrogen to explode out of the vacuum steel interface. With an experience proven required vacuum level of less than 1 millimeter mercury absolute, one can describe, as a practical matter, the number of stages of steam jet ejectors required as shown below.

All Vacuum Levels in Inches Hg Absolute

Operating Level × Compression Ratio = Discharge Pressure

Stage 1: $0.5 \times 6.25 = 3.125$ (approx. 3")
Stage 2: $3.125 \times 6.25 = 19.53$ (approx. 20")
Stage 3: $19.52 \times 6.25 = 122.06$ (approx. 120")
Stage 4: $120.06 \times 6.25 = 762.89$ (approx. 760")

In order to turn on the ejector properly, one must pump down sequentially in order to have the stages function properly within their operating ranges. In a 4 stage system, for instance, Stage 4, the stage which discharges to atmosphere, is the first turned on and is the only stage which operates until 120 millimeters mercury absolute is approached; then Stage 3 is turned on and so on. These stages can be manually turned on by observing a vacuum gauge or sequentially turned on automatically by either time or vacuum level.

Neither of these two automatic systems provide minimum pump down time. Specifically, they cannot allow for gas load in the steel and slag—which vary with the steel-making and deoxidation procedures, humidity, and moisture or condensation in the vacuum system. Too fast a pump down with a high gas load in the steel and slag can cause a disastrous boilover; and too slow a pump down wastes time and energy.

The ramp modulating procedure of this invention senses vacuum level in the first stage inlet or plenum or vacuum tank and automatically turns on stages at the optimum stage-operating pressure while isolating the ejector system from the ladle vacuum chamber (or vacuum ladle) with an isolating valve. The isolating valve is normally open and is only throttled when the boil in the ladle rises to the brim of the ladle. The boil is held close to this maximum tolerable height either by visual operation of the isolating valve or by automatic control sensing boil height, or by anticipating a rise in the height of boil prior to turning on a next lower ejector stage, as for instance stage 2, and positioning the valve accordingly by automatic means.

This technique relieves the operator of turning stages on and off to control boil height which is tedious and time consuming; i.e.: as stages are turned off, in the prior art systems, the boil subsides almost completely and the system must again be pumped down to the maximum tolerable boil level. This incremental procedure is repeated until enough gas (mainly CO) is removed from the steel so all stages and maximum vacuum can be utilized. By contrast, pumping down with throttling as disclosed in this invention allows maximum degassing at all times thereby providing the shortest possible pump down time without boiling over.

One specific embodiment of the throttling concept may entail the use of an automatic control of the time at which the successive stages are trrned on (i.e.: the successive stages are cut in at pre-determined time intervals), with throttling of the first stage inlet being controlled by the operator. Even this operator involvement can be eliminated by the use of a boil height sensing system which functions to control the throttle valve in response to boil height.

In more sophisticated installations, carbon boil and deoxidation practices can be fed into a micro-processor thereby controlling vacuum ramp-down levels versus time to provide optimum cycles.

II—Proportionally Matching Online Electrode Voltage to Vacuum Levels to Avoid Incipient Glow The second technique, which can be used with, or without, controlled pumpdown, shortens cycle time by online voltage reduction with an increase in vacuum level to thereby skirt incipient glow.

VAD is normally operated from an initial closed-chamber condition which results in a slight vacuum to a vacuum of 200 millimeters mercury absolute for optimum heating under vacuum without glow. The system can drift slightly below 200 millimeters mercury absolute without glow, but for consistent operation, glow is avoided by staying around 200 millimeters mercury absolute which is a normal operating procedure as illustrated in the following chart.

CHART 1

CONVENTIONAL VAD CYCLE WITHOUT SHEDDING VOLTAGE
ZERO Δt AT VAC TANK: 66 TON MEDIUM CARBON STEEL

| TIME | Δt | FUNCTION | TEMPERATURE |
|---|---|---|---|
| 0 | | at Vac Tank | 2850° F. |
| 2 | 2 | Take Tests t = 5°/min. loss = −10° | 2840° F. |
| 10 | 8 | Arc Heat while Pump to 200 mm t = 8 × 2½°/min. = ≠20° | 2860° F. |
| 27 | 17 | Arc Heat at 200 mm t = 17 × 4½ = 76½ | 2936° F. |
| 32 | 5 | Pump Down to 1 mm t = 5 × −6° = 30° | 2906° F. |
| 40 | 8 | 8 minutes at max. vac. t = 8 × −6° = −48 | 2858° F. |
| 42 | 2 | 2 min. break vac. & take test = 2 × −2° = −4 | 2854° F. |
| 44 | 2 | 2 min. hook up 2 × −2° = −4 | 2850° F. |

Chart 1 shows a typically degassed heat tapping at air cast non-degassed temperatures. The heat loss of degassing is made up by vacuum arc heating. This cycle for a 66-ton heat and 5¼ megawatts three-phase AC power takes 44 minutes during which arc heating is used for 25 minutes. The arcs are used only at 200 millimeters of mercury to avoid the glow range, while arcing at 225 volts.

This invention for a similar 66-ton heat also operates at 225 volts, but for only 18 minutes. An online tap changer which can either automatically or manually shed voltage is used as the system is pumped down, thereby just staying out of reach of glow as shown in Chart 2.

CHART 2

SHEDDING VOLTAGE CYCLE
ZERO Δt C VACUUM TANK

| TIME | Δt | FUNCTION | TEMPERATURE |
|---|---|---|---|
| 0 | | at Vac tank | 2850° F. |
| 2 | 2 | Take Tests | 2840° F. |
| 10 | 8 | Arc Heat While Pump to 200 mm 8 × +2½ = +20 | 2860° F. |
| 20 | 10 | Arc Heat at 200 mm - B Tap 10 × +4½ = +45 | 2905° F. |
| 22 | 2 | Arc Heat to 20 mm - C Tap 2 × +1 = +2 | 2907° F. |
| 24 | 2 | Arc Heat to 2 mm - D Tap 2 × −1 = −2 | 2905° F. |
| 25 | 1 | Arc Heat to 1 mm - E Tap 1 × −2 = −2 | 2903° F. |
| 33 | 8 | Degas at Max. Vacuum 8 × −6 = −48 | 2855° F. |
| 35 | 2 | Take Test 2 × −2 = −4 | 2851° F. |
| 37 | 2 | Hook Up 2 × −2 = −4 | 2847° F. |

DESIGN PARAMETERS ON 66-TON UNIT

| | |
|---|---|
| 0–2 min. | Take Tests |
| 2–10 min. | Lose 8°/min. or heat at 2½°/min. on B Tap |
| 10 min. & thereafter | Gain 4½°/min. on B Tap 225 Volts 5250 KW<br>180 Volts 3367 KW<br>Lose 1°/min. on D Tap 150 Volts 2338 KW |

CHART 2-continued

| | |
|---|---|
| | Lose 2°/min. on E Tap 138 Volts 1979 KW |
| | Lose 3°/min. on F Tap 118 Volts 1447 KW |
| Break Vac & Take Test | Lose 2°/min. |
| Hook Up Crane to Ladle | Lose 2°/min. |
| ARC & VACUUM PUMPING CHARACTERISTICS | |
| to 200 mm Hg | Takes 1½ to 2 minutes - B Tap 235 Volts can arc at 200 mm without glow |
| 200 to 20 mm HG | Takes 2 minutes - C Tap 180 Volts can arc for short periods at 20 mm without glow |
| 20 to 2 mm HG | Takes 2 minutes - D Tap 150 Volts can arc for short periods at 2 mm without glow |
| 2 to 1 mm HG | Takes 1 minutes - E Tap 138 Volts can arc for short periods at 1 mm without glow |

By keeping power on, even at reduced power a double savings is incurred as the uninhibited loss of temperature of degassing at lower vacuum levels without arcing is always present. Therefore, when vacuum arc heating, even at lower input, energy is absorbed by the bath during a normally non-arc period. This energy absorption shortens vacuum time which normally would result in a further heat loss and, of course, bath heat or contained energy in the steel dictates process time.

The evasion of glow with relation to vacuum level and arc heating was determined experimentally at a 66-ton VAD installation having an impedance of 0.006 ohms at a maximum current of 20,000 amps. With a stiffer system having lower impedance and more power, arcing could actually occur in the dehydrogenation equipment. By controlling the rate of vacuum pumpdown and simultaneously reducing or shedding arc voltage, the VAD system is able to further skirt glow. This technique permits arcing without glow to occur while adding heat to the bath and/or losing less temperature during the normally non-arc pumpdown period. A good amount of oxygen removal is accomplished during this period of heating while pumping down to 100 mm Hg and less, thereby permitting a more uniform boil while lowering the absolute pressure. See for example page 4, column 1, lines 72–75 in U.S. Pat. No. 3,635,696. This reduces the possibility of boil over on low freeboard ladles and further reduces process time.

Chart 1 and Chart 2 show a time savings of 16% when comparing conventional VAD with the shedding voltage cycle of this invention, as follows:

| CONVENTIONAL VAD | SHEDDING VOLTAGE CYCLE |
|---|---|
| 44 minutes | 37 minutes |

Savings = 7 minutes or $\frac{7}{44}$ = 16% savings in time

Voltage shedding also shows an energy savings of 16%:

$2.12/ton $1.80/ton or $\frac{\$2.12 - \$1.80}{\$2.12} = 16\%$

Savings = $2.12 − $1.80 = $0.32 or 32 cents/ton

Chart 3

COST SAVINGS: CONVENTIONAL VAD v. THIS INTENTION

| CONVENTIONAL VAD | VAD WITH VOLTAGE SHEDDING |
|---|---|
| Arc 25 min. at 5¼ MW = | 18 Min. B Tap at 5.2157 W × $\frac{16}{60}$ = 1.575 Hr. |
| 5250 × $\frac{25}{60}$ = 2.1875 MW hrs. | 2 Min. C Tap at 3.367 W × $\frac{2}{60}$ = 0.112 Hr. |
| | 2 Min. D Tap at 2.338 W × $\frac{2}{60}$ 0.078 Hr. |
| | 1 Min. E Tap at 1.719 W × $\frac{1}{60}$ = 0.028 Hr. |
| | 25 minutes E Tap at 1.719 W × $\frac{1}{60}$ = 1.793 MW Hrs. |
| for 66 Tons = $\frac{2.1875}{77}$ = 33 KW/Ton | for 66 Tons = $\frac{1754}{66}$ = 27.16 KW/Ton |
| at 6.625 cents/KW = $2.12/Ton Treated | at 6.625 cents/KW = $1.80/Ton |

range. Such a result has been proven during pilot tests at voltages between 80 and 100 volts at pressures below 1 mm Hg absolute.

This second new technique avoids the problem of vacuum/voltage related glow which in turn results in a short-circuit condition, thereby reducing heat into the metal bath and overheating the AC power transmission Again these savings of 16% in time and energy are based on a 66-ton heat. Similar savings will occur on any heat size treated by VAD.

The significance of a savings of 7 minutes in cycle time (which could even be greater with a stiffer system)

is important when considering 40 minutes tap to tap time from a pneumatic furnace. The conventional 44 minutes VAD cycle time would require two units to keep up with a Basic Oxygen Furnace, whereas the shorter cycle time of 37 minutes permits utilization of a single VAD.

In addition, the ability to use arcs at high vacuum allows a further reduction in cycle time over the VAD voltage shedding cycle. By skillful design of the electrical system it is possible to reduce the impedance of the system to the extent that sufficient current can be passed to the bath at low voltage; i.e.: low enough to skirt the glow range, and to impart energy in the range 2000 KW, at pressure of 1 mm Hg absolute or less. This arc heating continues throughout the entire cycle with time savings of 6–7 minutes in addition to the savings shown during the voltage shedding cycle.

For example, and using the 66-ton VAD installation mentioned above, a stable AC heating arc can be obtained at 1 mm Hg or less, as follows.

With an electrical system having a reactance of $x=3.5\times10^{-3}+2.54=13100$ amps at 0.707 power factor.

$$\text{KW} = 13100 \times 100 \times \sqrt{3} \times \frac{1}{1000} = 2272$$

For a 60-ton medium carbon heat, this translates to $$2272 = \frac{132{,}000 \times .18 \times t \times 60}{3416 \times 80\% \text{ efficiency}}$$
$$t = 4.35^\circ \text{ F.}$$

If a normal loss experience is 6° F., then a temperature rise of 4° F. results in a net loss of only 2° F.

Figure 3:
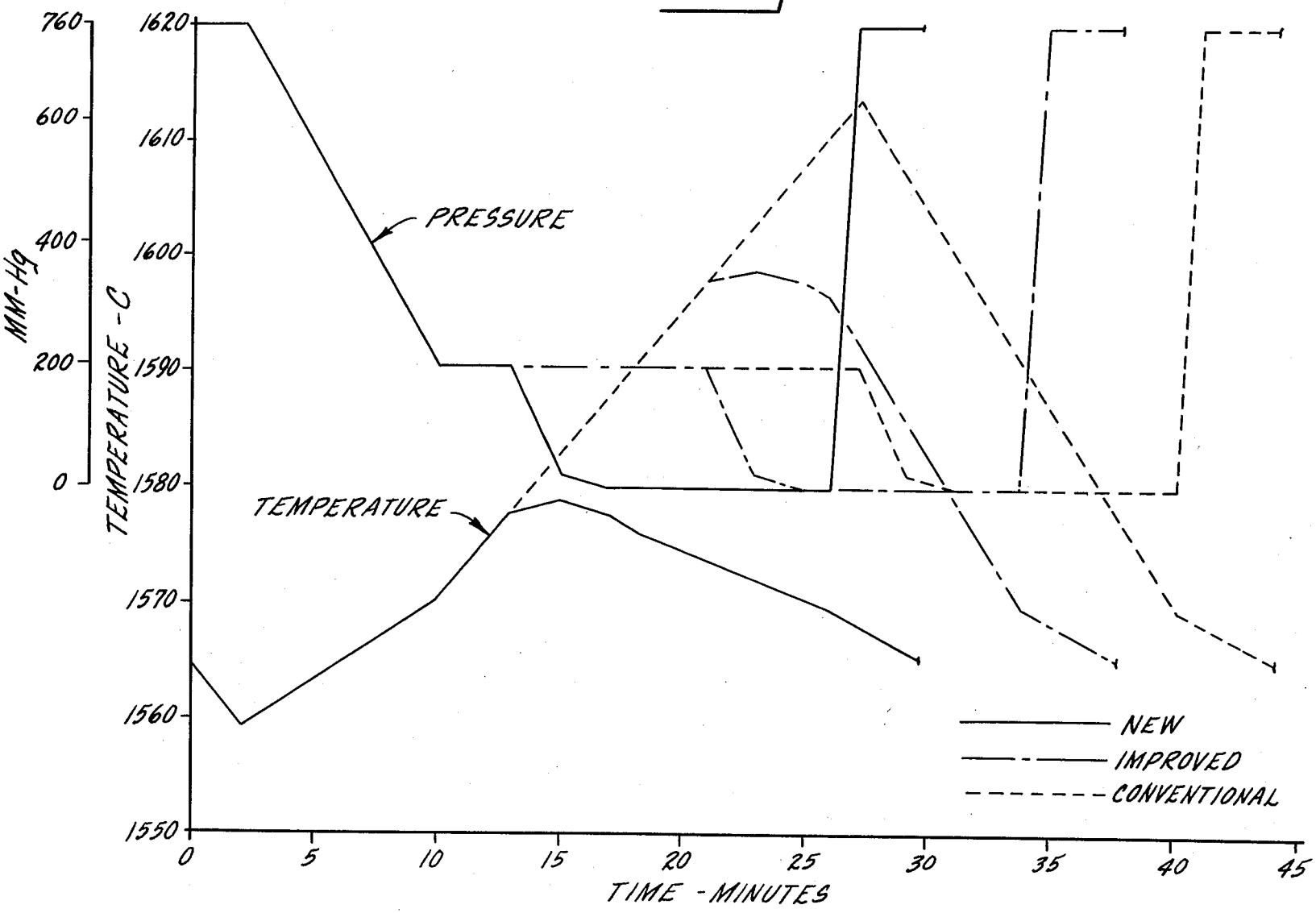
FIG. 3 is a time-temperature-pressure curve illustrating the further refinement of operation of the AC arc at full vacuum; i.e.: at less than 1 mm Hg.

In summary, for the conditions described, an additional cycle time saving of 6 to 7 minutes may be achieved. This time saving is illustrated in FIG. 3 which discloses a VAD cycle embodying the new technique described immediately above as a "NEW" cycle, and the technique described elsewhere herein as an "IMPROVED" cycle.

Normally, highly basic slags have extremely high melting points (approx. 3000° F.) During a conventional VAD treatment, the slag tends to cake, lose fluidity, and impede the exposure of metal droplets to the vacuum.

The additional fluidization of slag from the use of arcs into the high vacuum range enhances $H_2$ removal by up to 0.6 ppm over the normal VAD cycle.

III—Insuring Sufficient Metal Circulation as Heat Size Increases

In a conventional VAD system, only a single gas purging source is used whether said source be a porous refractory inserted into wall or bottom, or a tuyere similarly installed, or an insuflation device in a sliding-type valve. However, surprisingly, findings over a significant number of heats showed a reduction of 0.3 ppm hydrogen when using more than one purging brick in a 66-ton heat.

As the operation of VAD requires proper stirring to present un-degassed metal to the metal-slag-vacuum interface, proper operation of purging or stirring equipment is essential. A 66-ton heat averaging 25 heats per ladle lining and purging plug and setting block has a cost of 13½ cents/ton per purging set calculated as follows:

Purging Block & Plug (Brick) Set=$223.02
66 tons×25 heats=1650 tons/set or 13½ cents/ton A double purging installation naturally doubles this cost of 13½ cents/ton; but either (i) a 0.3 ppm hydrogen reduction, (ii) a corresponding shortened degassing time of several minutes, or (iii) the security of double equipment on larger heat sizes more than offsets the increased cost.

Normally, a purging brick or plug is bottom installed mid-radius to be most effective and handles up to 50 tons nicely. A maximum of 5 CFM (one compressor horsepower) can cause a boilover. Nevertheless, as ladle diameter and volume increase, additional purging points at 120° intervals prove more effective. By extrapolating from existing data, the following table is cost justified:

| SIZE | NUMBER OF PURGING BRICKS |
|---|---|
| up to 50 Tons | 1 mid-radius |
| 50 to 150 Tons | 2 mid-radius 120° apart |
| over 150 Tons | 3 mid-radius 120 × 120° apart |

FIG. 1 is a graph comparing the data of Charts 1 and 2 in the text. The shaded portion shows that by start of shedding at 21 minutes, the former peak temperature of 2936° is lowered to approximately 2907°. The shaded area thus shows a savings in time, energy and refractory wear since it is well understood by those skilled in the art that lowering temperatures decreases refractory erosion. FIG. 1 also shows that 2850°, which is the desired temperature, was reached in 37 minutes with shedding and in 44 minutes without shedding. Similarly FIG. 3 shows that 2850° was reached in 30 minutes by arc heating at full vacuum versus 44 minutes for the conventional cycle.

Figure 2:
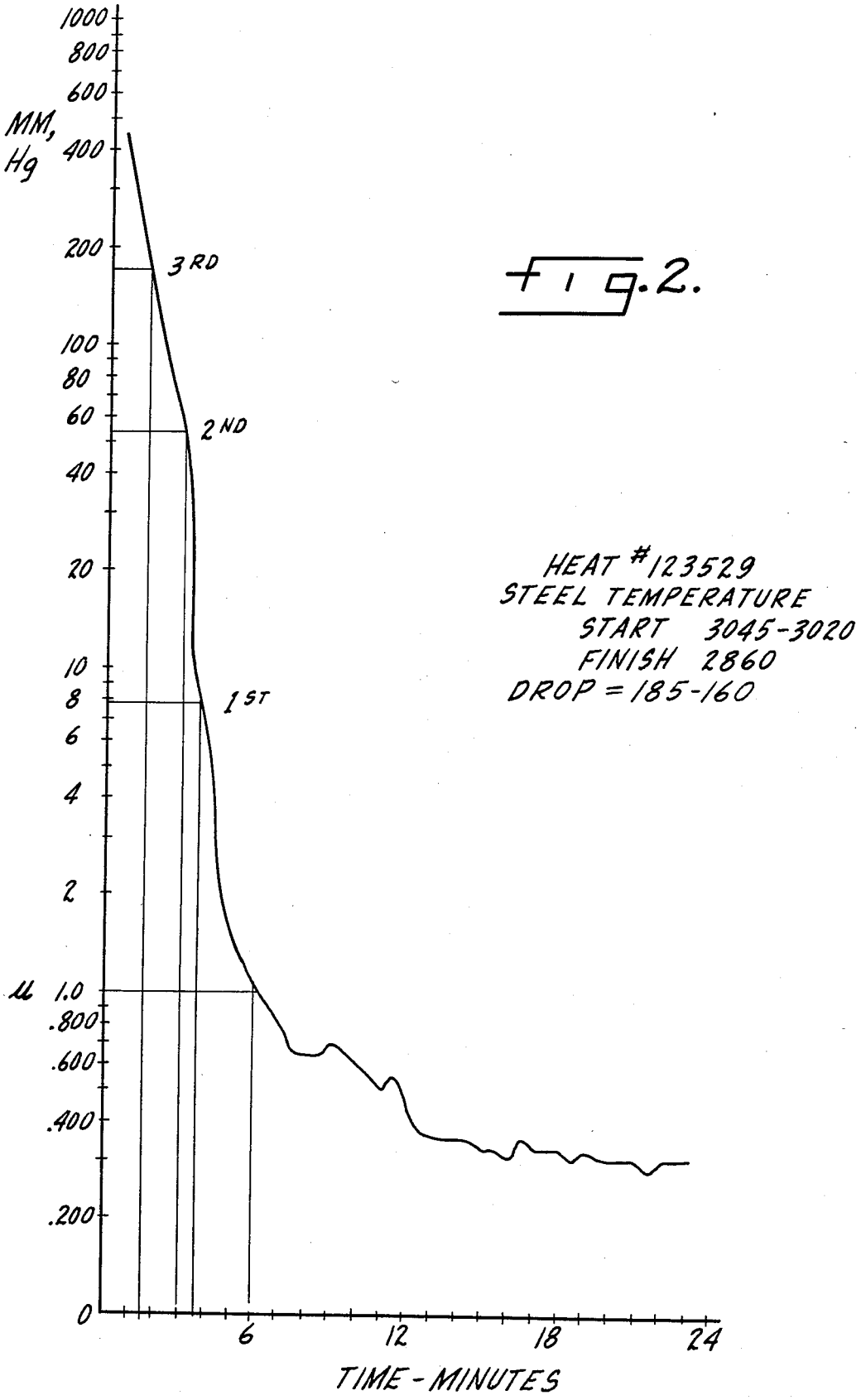
FIG. 2 is a time-pressure curve illustrating the time and temperature savings which result from application of the improvements described in this application as compared to a conventional VAD process.

FIG. 2 illustrates a typical degassing cycle with medium carbon low alloy steel in the tank. This Figure illustrates the fact that a vacuum of about 20 millimeters is reached at 1½ minutes, 20 millimeters at about 4 minutes, 2 millimeters at 5½ minutes, and 1 millimeter at 7 minutes.

From the above description it will be apparent to those skilled in the art that none of the above three features are inconsistent, or offsetting, with respect to one another, nor is any one or two features dependent on the operation or non-operation of any other feature. Accordingly, the features may be employed individually, in any combination of two, or all three simultaneously in conjunction with a conventional VAD process.

Although a preferring embodiment of the invention has been illustrated and described it will at once be apparent to those skilled in the art that further modifications may be made within the spirit and scope of the invention. Accordingly it is intended that the invention be limited not by the scope of the foregoing description but solely by the scope of the hereinafter appended claims when interpreted in view of the pertinent prior art.

I claim:

1. A method of steel making comprising the operations of (1) adjusting the degree of vacuum of a steel melt contained in a receptacle having a bottom and side walls so as to effect gas removal from the said melt at a rate just short of that which would cause boil-over of the said melt, (2) stirring the said melt at a rate effective to transport molten steel of said melt from the bottom of said receptacle to the surface, operations (1) and (2) being carried out simultaneously, and (3) subjecting the said melt to an alternating current heating arc which is struck between electrode means and said steel during at least a portion of the time operations (1) and (2) are carried out.

2. The method of steel making of claim 1 further characterized firstly, in that the vacuum is created by steam jet ejector means, and secondly, in that the adjustment of the degree of vacuum whereby the magnitude of the vacuum is matched with the rate of gas evolution from the steel from time to time as the method proceeds is effected by throttling the steam jet ejector means.

3. A method of steelmaking comprising the operations of (1) subjecting a steel melt contained in a receptacle having a bottom and sidewalls to a vacuum so as to effect gas removal from the said melt, (2) stirring the said melt at a rate effective to transport molten steel of said melt from the bottom of said receptacle to the surface, operations (1) and (2) being carried out simultaneously, (3) subjecting the said melt to an alternating current heating arc which is struck between electrode means and said steel during at least a portion of the time operations (1) and (2) are carried out, and (4) decreasing the voltage of the alternating current heating arc with a decrease in the absolute pressure of the vacuum at a rate just sufficient to avoid glow.

4. A method of steelmaking comprising the operations of (1) subjecting a steel melt contained in a receptacle having a bottom and side walls to a vacuum so as to effect gas removal from the said melt, (2) stirring the said melt at a rate effective to transport molten steel of said melt from the bottom of said receptacle to the surface, operations (1) and (2) being carried out simultaneously, (3) subjecting the said melt to an alternating current arc which is struck between electrode means and said steel during at least a portion of the time operations (1) and (2) are carried out, said stirring being effected by gas purging means, said gas purging means including at least two gas emission locales, each gas emission locale being located approximately at the mid-radius of the body of molten metal, said gas emission locales being located at least 120° from each other as measured with respect to the center of the body of molten steel.

5. A method of steelmaking comprising the operations of (1) adjusting the degree of vacuum of a steel melt contained in a receptacle having a bottom and side walls so as to effect gas removal from the said melt at a rate just short of that which would cause boil-over of the said melt, (2) stirring the said melt at a rate effective to transport molten steel of said melt from the bottom of said receptacle to the surface, operations (1) and (2) being carried out simultaneously, and (3) subjecting the said melt to an alternating current heating arc which is struck between electrode means and said steel during at least a portion of the time operations (1) and (2) are carried out, and (4) decreasing the voltage of the alternating current heating arc with a decrease in the absolute pressure of the vacuum at a rate just sufficient to avoid glow.

6. The method of steelmaking of claim 5 further characterized in that said stirring is effected by gas purging means, said gas purging means including at least two gas emission locales, each gas emission locale being located approximately at the mid-radius of the body of molten metal, said gas emission locales being located at least approximately 120° from each other as measured with respect to the center of the body of molten metal.

7. The method of steelmaking of claim 5 further characterized in that the alternating current heating arc voltage is decreased to a level which enables the alternating current heating arc to be maintained in the pressure range of about 1 mm Hg.

8. The method of steelmaking of claim 7 further characterized in that the voltage is maintained at a level no higher than about 90 volts when in the pressure range of about 1 mm Hg.

9. The method of claim 3 further characterized in that the alternating current heating arc voltage is decreased to a level which enables the alternating current heating arc to be maintained in the pressure range of about 1 mm Hg.

10. The method of claim 9 further characterized in that the voltage is maintained at a level no higher than about 90 volts.

* * * * *